US011433565B2

(12) United States Patent
Lin et al.

(10) Patent No.: US 11,433,565 B2
(45) Date of Patent: Sep. 6, 2022

(54) METHOD FOR PREPARING HYDROPHILIC WRITING SLICED BAMBOO VENEER

(71) Applicant: Xinyan Lin, Zhejiang (CN)

(72) Inventors: Xinyan Lin, Hangzhou (CN); Ning Yi, Hangzhou (CN)

(73) Assignee: Xinyan Lin, Hangzhou (CN)

( * ) Notice: Subject to any disclaimer, the term of this patent is extended or adjusted under 35 U.S.C. 154(b) by 176 days.

(21) Appl. No.: 16/635,556

(22) PCT Filed: Jul. 10, 2018

(86) PCT No.: PCT/CN2018/095111
§ 371 (c)(1),
(2) Date: Jan. 31, 2020

(87) PCT Pub. No.: WO2019/024662
PCT Pub. Date: Feb. 7, 2019

(65) Prior Publication Data

US 2020/0254645 A1 Aug. 13, 2020

(30) Foreign Application Priority Data

Aug. 2, 2017 (CN) ..... 201710653312.6

(51) Int. Cl.

| | |
|---|---|
| ***B27D 5/00*** | (2006.01) |
| ***B27J 1/00*** | (2006.01) |
| ***B27K 9/00*** | (2006.01) |

(52) U.S. Cl.
CPC ..... *B27J 1/00* (2013.01); *B27D 5/00* (2013.01); *B27K 9/002* (2013.01)

(58) Field of Classification Search
CPC ..... B27D 5/00
See application file for complete search history.

(56) References Cited

FOREIGN PATENT DOCUMENTS

| | | | | |
|---|---|---|---|---|
| CN | 1304826 | A | * | 7/2001 |
| CN | 1465473 | A | * | 1/2004 |
| CN | 105386360 | A | * | 3/2016 |
| JP | 08309711 | A | * | 11/1996 |
| JP | 2012201035 | A | * | 10/2012 |

* cited by examiner

*Primary Examiner* — Matthew Katcoff

(57) ABSTRACT

Disclosed is a method for preparing a hydrophilic writing sliced bamboo veneer, including, in sequence, the following steps: (1) processing a sliced bamboo veneer into thin bamboo sheets with a thickness of 0.2-0.6 mm; (2) selecting the thin bamboo sheets with less color difference and fewer processing defects, and rolling the selected thin bamboo sheets on a plane; (3) performing deburring, sanding, and surface polishing on the rolled thin bamboo sheets; (4) performing mildewproofing and mothproofing treatment on the thin bamboo sheets; (5) performing surface coating treatment on the thin bamboo sheets using a coating material; (6) drying the coated thin bamboo sheets at low temperature; (7) fine-polishing the dried thin bamboo sheets; (8) cutting the thin bamboo sheets; and (9) flattening, compacting, and piling the cut thin bamboo sheets for future use.

9 Claims, No Drawings

METHOD FOR PREPARING HYDROPHILIC WRITING SLICED BAMBOO VENEER

BACKGROUND OF THE INVENTION

1. Technical Field

The present invention relates to preparation of carriers for writing and printing, and more particularly to a method for preparing a hydrophilic writing sliced bamboo veneer.

2. Description of Related Art

Collectively called "the Four Treasures of the Study," writing brushes, ink sticks, paper and ink stones are traditional writing and painting tools to Chinese people. Particularly, the Chinese papermaking technology has made great contribution to universal propagation and popularization of knowledge. While the development of modern pulp and paper industry satisfies the increasing consumer demands, it has brought about environmental problems, such as pollution and deforestation. Bamboo slips used to be a main carrier of writing in ancient China. Theoretically, bamboo materials can be used as carriers of writing when proper treatment is provided. China Patent Document No. CN1465473A, published on Jan. 7, 2004, discloses "improved planed thin bamboo and a productive method thereof," which involves: integrating a stack of pretreated untinted or carbonized bamboo sheets into a stacked bamboo block under pressure (2); immersing the bamboo block under pressure, drying the bamboo block, applying adhesive and compressing the bamboo block into a bamboo cubic; slicing the bamboo cubic with a plane blade inclined by an angle $\alpha$ of 0~45° with respect to the direction of the bamboo fibers, and obtaining sliced veneers after drying. It is preferred that the bamboo cubic is soaked in warm water and softened before planed. The resulting sliced bamboo veneer has a width equal to a sum of thicknesses or widths of the plural bamboo sheets and has a thickness of 0.15~2.00 mm. The sliced bamboo veneer has adhesive layers and process layers. To use the bamboo veneer produced using the known method as a substitute for paper, there are two issues to be addressed. The first is about hydrophilic properties. Since bamboo fibers and paper fibers are very different in terms of arrangement, water-based ink permeates them very differently, and this is the reason why sliced bamboo veneers are not a good carrier of painting, calligraphy and printing. The second issue is bendability. It is common that traditional Chinese painting and calligraphy works are normally rolled up for easy storage. However, due to the directional singularity of bamboo fibers, the conventional bamboo veneers are usually stiff and brittle, thus tending to crack when bent along the direction of bamboo fibers and tending to break when bent against the direction of bamboo fibers. These properties make it difficult to fold or roll up bamboo veneers into a desired size for book binding and easy storage/preservation.

SUMMARY OF THE INVENTION

In order to address the foregoing issues, the objective of the present invention is to provide a method for preparing a hydrophilic writing sliced bamboo veneer.

For achieving the aforementioned objective, the present invention adopts a technical scheme to present a method for preparing a hydrophilic writing sliced bamboo veneer, comprising, in sequence, the following steps:

(1) processing a sliced bamboo veneer into thin bamboo sheets with a thickness of 0.2-0.6 mm;

(2) selecting the thin bamboo sheets with less color difference and fewer processing defects, and rolling the selected thin bamboo sheets on a plane;

(3) performing deburring, sanding, and surface polishing on the rolled thin bamboo sheets;

(4) performing mildewproofing and mothproofing treatment on the thin bamboo sheets;

(5) performing surface coating treatment on the thin bamboo sheets using a coating material;

(6) drying the coated thin bamboo sheets at low temperature;

(7) fine-polishing the dried thin bamboo sheets;

(8) cutting the thin bamboo sheets; and (9) flattening, compacting, and piling the cut thin bamboo sheets for future use.

Therein, the coating material used in Step (5) is prepared from a coupling agent, a stabilizing agent, and a penetrating agent. At the beginning of the preparation, a volume ratio of the three agents is 60-70% of the coupling agent to 15-25% of the stabilizing agent to 10-15% of the penetrating agent, totaling 100%. The preparation comprises steps of:

(5-1) pouring the coupling agent into a reaction kettle, heating to 70-80° C., agitating for 30-60 seconds in an agitator with a rotational speed of 200 rpm; (5-2) introducing the stabilizing agent into the reaction kettle, holding the temperature at 70-80° C., agitating for 120 seconds in the agitator with a rotational speed of 550-600 rpm; and (5-3) cooling an internal temperature of the reaction kettle to room temperature, introducing the penetrating agent into the reaction kettle, and agitating for 120 seconds in the agitator with a rotational speed of 550-600 rpm.

The disclosed technical scheme obtains a sliced bamboo veneer using the existing technology, and then using steps such as (1) slicing, (2) roller compaction, (3) polishing, (4) mildewproofing and mothproofing, (5) coating, (6) drying, (7) fine-polishing, (8) cutting and (9) compacting and piling to produce a hydrophilic writing sliced bamboo veneer as a final products. The point of the process is that the stress in the thin bamboo sheets cut from the bamboo veneer has to be released first in order to prevent the resulting product from crimp and deformation. To do this, roller compaction is applied to thin bamboo sheets so as to make the stiff and brittle adhesive layers and bamboo fibers have tiny cracks and become loose, thereby disorganizing the inherent neat arrangement of the bamboo fibers and distributing the interior stress. After the bamboo fibers are scattered, the thin bamboo sheets can show good bendability. The thinner the bamboo fibers are, the more bendable the thin bamboo sheets are. Secondary, surface coating treatment is performed on the thin bamboo sheets so as to endow their surface with hydrophilic properties and provide some binding effects, which prevent the bamboo fibers from excessive separation and secure the bamboo fibers together. Additionally, after cutting, the cut bamboo sheets have to be flattened, compacted and piled, so that the thin bamboo sheets can have their water contents rebalanced during rest in piles, thereby eliminating the risks of crimping and wrinkling and meeting the requirements for writing and printing. The cutting may be performed according to the standard specifications or general norms in recognized in the papermaking industry. Alternatively, the thin bamboo sheets may be joined in width or in length before rolled up and cut into rolls. Further alternatively, the thin bamboo sheets may be the thin bamboo sheets may be cut into special specifications according to market need.

The coupling agent, the stabilizing agent, and the penetrating agent that make up the coating material used in the coating process may be selected from those commercially available.

Preferably, in Step (2), the roller compaction is executed using an opposite-roller compaction machine. The opposite-roller compaction machine has a pair of steel rollers that contact mutually at surfaces and roll in opposite directions. Therein, the upper roller has its surface formed with raised tiny patterns while the lower roller has a smooth surface. For ensuring even compaction of the bamboo sheets, the disclosed scheme employs an opposite-roller compaction machine whose steel roller pair is reliable for compaction and allows adjustment of the gap and pressure formed between the steel rollers.

Preferably, the patterns form a mountain grain, having a line thickness of 0.8-1 mm and a flange height of 0.5-0.6 mm. The mountain grain features long and smoothly curved lines that randomly extend across the direction of the bamboo fibers. There may be another structural direction formed in addition to the direction of the bamboo fibers so as to enhance the overall density of the bamboo sheets. Selection of the line thickness and flange height is made for not only adapting the product to writing and printing uses, but also improving the structural strength of the mountain grain.

Preferably, the mildewproofing and mothproofing treatment in Step (4) uses a water-based mildewproofing agent and is followed by oven drying. The use of the water-based mildewproofing agent is for deeper infiltration in the bamboo fibers and in turn more thoroughgoing treatment results and longer duration. The final product so made is expected to have good hydrophilicity and suitable for writing and printing.

Preferably, the temperature for oven drying is controlled at 80-90° C. When the oven drying temperature is low, the process takes more time. A higher oven drying temperature, nevertheless, forms strong water vapor that may disarrange the fibers in the bamboo sheets and leaves the surface roughness of the bamboo sheets out of control and failing to satisfy writing and printing requirements. Therefore, the present scheme sets a temperature for oven drying at 80-90° C.

Preferably, in Step (6), the low temperature for drying is held between room temperature and 60° C. The objective of this step is to further remove moisture from the bamboo sheets, making them more close to the final product in terms of both temperature and moisture.

Preferably, in Step (9), the cut thin bamboo sheets rest in piles for 3-7 days. After being cut into regular dimensional specifications for paper products, the cut thin bamboo sheets are piled and left still for several days. This allows stress built up in the bamboo sheets during processing to be released. With this step, the thin bamboo sheets are prevented from slight extension/shrinkage and deformation so as to maintain consistent flatness.

Preferably, the ambient humidity for storage of the bamboo sheet piles is controlled at 10%-20%. The moisture of the bamboo sheets determines how much affinity is between ink and the bamboo sheet surface, and has significant influence on spread and permeation of ink applied to the bamboo sheet surface. In practical use, the ambient humidity is controlled at 10%-20%, depending on local natural environments. For less humid places, the control parameter for lower humidity may be selected and for more humid places, the control parameter for higher humidity may be selected.

Preferably, the sliced bamboo veneer may be replaced by sliced wood veneer or rotary cut wood veneer. The sliced wood veneer refers to xylem collected from trees and processed using the process for preparing the disclosed sliced bamboo veneer. The rotary cut wood veneer refers to xylem obtained from trees using rotary cutting and processed using the process for preparing the disclosed sliced bamboo veneer. The sliced wood veneer and the rotary cut wood veneer are both processed from logs. By slicing xylem of raw trees into thin sheets and processing the thin xylem sheets using the process for preparing the disclosed sliced bamboo veneer, the resulting material can be used instead of the sliced bamboo veneer for the purpose of the present scheme.

To sum up, the present invention has the following beneficial effect. It provides a method for preparing a hydrophilic writing sliced bamboo veneer that endows the sliced bamboo veneer with good hydrophilicity, so as to satisfy the requirements for writing in ink and printing in ink.

DETAILED DESCRIPTION OF THE INVENTION

The invention as well as a preferred mode of use, further objectives and advantages thereof will be best understood by reference to the following detailed description of illustrative embodiments when read in conjunction with the accompanying drawings.

In one embodiment of the present invention, a method for preparing hydrophilic writing sliced bamboo veneer primarily comprising the following steps in sequence:

(1) processing a bamboo veneer into bamboo sheets having a thickness of 0.4 mm;

(2) selecting the thin bamboo sheets with less color difference and fewer processing defects, and rolling the selected thin bamboo sheets on a plane, wherein according to the present embodiment an opposite-roller compaction machine used for this step has a pair of steel rollers that contact mutually at surfaces and roll in opposite directions, and the upper roller has its surface formed with raised tiny patterns while the lower roller has a smooth surface, in which the patterns form a mountain grain, having a line thickness of 0.8-1 mm and a flange height of flange height of 0.5-0.6 mm;

(3) performing deburring, sanding, and surface polishing on the rolled thin bamboo sheets;

(4) performing mildewproofing and mothproofing treatment on the thin bamboo sheets, wherein the step is conducted using a water-based mildewproofing agent supplied by Hangzhou Hangzhou Johnson Sylvan Inc. is followed by oven drying at a temperature of 80-90° C.;

(5) performing surface coating treatment on the thin bamboo sheets using a coating material; wherein the coating material is made up by a coupling agent, a stabilizing agent, and a penetrating agent and at the beginning of the preparation, a volume ratio of the three agents is 60-70% of the coupling agent to 15-25% of the stabilizing agent to 10-15% of the penetrating agent, totaling 100%, in which the three agents may be a coupling agent supplied by Hangzhou Sheng-Di-Wei-Ka Industry and Trading Co., Ltd. and modeled "ZW07" with a purity of 96%; a stabilizing agent supplied by Hangzhou Rui-Zhu Technology Co., Ltd. and modeled "WD1705;" and a penetrating agent supplied by Hangzhou Hangzhou Johnson Sylvan Inc. and modeled "CT609," the preparation comprising the following steps:

(5-1) pouring the coupling agent into a reaction kettle, heating to 70° C., agitating for 40 seconds in an agitator with a rotational speed of 200 rpm;

(5-2) introducing the stabilizing agent into the reaction kettle, holding the temperature at 70° C., agitating for 120 seconds in the agitator with a rotational speed of 600 rpm; and (5-3) cooling an internal temperature of the reaction kettle to room temperature, introducing the penetrating agent into the reaction kettle, and agitating for 120 seconds in the agitator with a rotational speed of 600 rpm;

(6) drying the coated thin bamboo sheets at low temperature, with the drying temperature controlled between room temperature and 60° C.;

(7) fine-polishing the dried thin bamboo sheets;

(8) cutting the thin bamboo sheets to meet the dimensional requirements for writing and printing; and (9) flattening, compacting, and piling the cut thin bamboo sheets for future use, wherein the cut thin bamboo sheets rest in piles for 3-7 days while the ambient humidity for storage of the bamboo sheet piles is controlled at 20%.

The material for preparing the sliced bamboo veneer of the present embodiment is prepared as taught by China Patent Document No. CN1465473A, titled "Improved planed thin bamboo and productive method thereof" and published on Jan. 7, 2004. Alternatively, a sliced wood veneer or a rotary cut wood veneer may be used instead of the sliced bamboo veneer. The sliced wood veneer refers to xylem collected from trees and processed using the process for preparing the disclosed sliced bamboo veneer. The rotary cut wood veneer refers to xylem obtained from trees using rotary cutting and processed using the process for preparing the disclosed sliced bamboo veneer.

The hydrophilic writing sliced bamboo veneer prepared according to the present embodiment meets China National Standards No. GB/T22828-2008 for Painting and Calligraphy Paper. As compared to traditional painting and calligraphy paper prepared from plant fibers, the hydrophilic writing sliced bamboo veneer of the present invention has comparable apparent density, brightness, breaking length, tearing resistance, wet tensile strength, water absorption, dimensional stability and dirt count, and even surpasses competitor products in some certain indicators. The hydrophilic writing sliced bamboo veneer of the present invention has gained recognition from Chinese brush calligraphy artists and when used for machine printing, provides good color reproduction and good penetration that leads to clear front-and-back color structures without reflection and glare, making it suitable for quality painting and calligraphy works.

What is claimed is:

1. A method for preparing a hydrophilic writing sliced bamboo veneer, comprising, in sequence, steps of:

(1)processing a sliced bamboo veneer into thin bamboo sheets with a thickness of 0.2-0.6 mm;

(2) selecting the thin bamboo sheets, and rolling the selected thin bamboo sheets on a plane;

(3) performing deburring, sanding, and surface polishing on the rolled thin bamboo sheets;

(4) performing mildewproofing and mothproofing treatment on the thin bamboo sheets;

(5) performing surface coating treatment on the thin bamboo sheets using a coating material;

(6) drying the coated thin bamboo sheets at low temperature;

(7) fine-polishing the dried thin bamboo sheets;

(8) cutting the thin bamboo sheets;

(9) flattening, compacting, and piling the cut thin bamboo sheets for future use;

wherein the coating material used in Step (5) is prepared from a coupling agent, a stabilizing agent, and a penetrating agent and at a beginning of preparation of the coating material, a volume ratio of the three agents is 60-70% of the coupling agent to 15-25% of the stabilizing agent to 10-15% of the penetrating agent, totaling 100%, and Step (5) further comprising steps of:

(5-1) pouring the coupling agent into a reaction kettle, heating to 70-80° C., agitating for 30-60 seconds in an agitator with a rotational speed of 200 rpm;

(5-2) introducing the stabilizing agent into the reaction kettle, holding the temperature at 70-80° C., agitating for 120 seconds in the agitator with a rotational speed of 550-600 rpm; and (5-3) cooling an internal temperature of the reaction kettle to room temperature, introducing the penetrating agent into the reaction kettle, and agitating for 120 seconds in the agitator with a rotational speed of 550-600 rpm.

2. The method of claim 1, wherein in Step (2), roller compaction is executed using an opposite-roller compaction machine, which has a pair of steel rollers that contact mutually and roll in opposite directions, in which an upper roller of the steel rollers has a surface formed with raised patterns while a lower roller of the steel rollers has a smooth surface.

3. The method of claim 2, wherein the patterns form a mountain grain, having a line thickness of 0.8-1 mm and a flange height of 0.5-0.6 mm.

4. The method of claim 1 or 2 or 3, wherein the mildewproofing and the mothproofing treatment in Step (4) uses a water-based mildewproofing agent and is followed by oven drying.

5. The method of claim 4, wherein the oven drying is performed at a temperature of 80-90° C.

6. The method of claim 1 or 2 or 3, wherein the low temperature for the drying of Step (6) ranges between room temperature and 60° C.

7. The method of claim 1 or 2 or 3, wherein in Step (9) the cut thin bamboo sheets rest in piles for 3-7 days.

8. The method of claim 7, wherein an ambient humidity for storage of the piles of the thin bamboo sheets is controlled at 10%-20%.

9. The method of claim 1 or 2 or 3, wherein the sliced bamboo veneer is replaced by a sliced wood veneer or a rotary cut wood veneer, in which the sliced wood veneer refers to xylem collected from a tree and processed using the process for preparing the sliced bamboo veneer while the rotary cut wood veneer refers to xylem obtained from a tree using rotary cutting and processed using the process for preparing the sliced bamboo veneer.

* * * * *